United States Patent [19]

Pollard et al.

[11] Patent Number: 4,823,867

[45] Date of Patent: Apr. 25, 1989

[54] FLUID FLOW APPARATUS

[76] Inventors: Raymond J. Pollard, 6 Sandringham Street, Alexandra Hills, Queensland, Australia, 4161; Geoffrey F. Ford, 574 Robinson Road, Aspley, Queensland, Australia, 4034

[21] Appl. No.: 917,024

[22] Filed: Oct. 9, 1986

Related U.S. Application Data

[63] Continuation of Ser. No. 410,900, Aug. 24, 1982, abandoned.

[30] Foreign Application Priority Data

Sep. 11, 1981 [AU] Australia ..... PF0723

[51] Int. Cl.[4] ..... F28F 3/02

[52] U.S. Cl. ..... 165/166; 165/167

[58] Field of Search ..... 165/166, 165, 167

[56] References Cited

U.S. PATENT DOCUMENTS

| | | | |
|---|---|---|---|
| 1,794,573 | 3/1931 | Arroult | 165/166 |
| 1,825,498 | 9/1931 | Wogan | 165/166 |
| 1,833,176 | 11/1931 | Lucke | 165/166 |
| 2,983,485 | 5/1961 | Peterson | 165/166 |
| 2,985,433 | 5/1961 | Sunpelaar | 165/166 |
| 3,106,243 | 10/1963 | Knudsen | 165/167 |
| 3,155,565 | 11/1964 | Goodman | 165/167 X |
| 3,225,823 | 12/1965 | Frohlich | 165/166 |
| 3,272,260 | 9/1966 | Raub et al. | 165/166 |
| 3,454,082 | 7/1969 | Harke | 165/166 |
| 3,461,956 | 8/1969 | Otto | 165/166 |
| 3,513,907 | 4/1968 | Hughes | 165/166 |
| 3,538,718 | 11/1970 | Karbosky | 165/166 |
| 3,986,549 | 10/1976 | Huggins et al. | 165/166 |
| 4,179,781 | 12/1979 | Long | 165/166 |
| 4,201,263 | 5/1980 | Anderson | 165/166 |
| 4,282,834 | 8/1981 | Anderson | 165/166 |
| 4,282,927 | 8/1981 | Summon | 165/166 |
| 4,300,627 | 11/1981 | Cleveland et al. | 165/166 X |
| 4,354,551 | 10/1982 | Kristoffersson et al. | 165/166 |
| 4,377,201 | 3/1983 | Kruse et al. | 165/166 |
| 4,442,886 | 4/1984 | Dunulesur | 165/166 |

FOREIGN PATENT DOCUMENTS

| | | | |
|---|---|---|---|
| 89517 | 7/1900 | Canada . | |
| 244511 | 11/1924 | Canada . | |
| 530281 | 9/1956 | Canada . | |
| 542742 | 6/1957 | Canada . | |
| 2033570 | 5/1980 | United Kingdom | 165/166 |

*Primary Examiner*—Michael Koczo
*Assistant Examiner*—Peggy Neils
*Attorney, Agent, or Firm*—Lackenbach Siegel Marzullo & Aronson

[57] ABSTRACT

This invention relates to fluid flow apparatus such as a heat exchanger. The heat exchanger includes inlet means, outlet means and a core element. The core element has a plurality of flow passages for a process fluid and a multiplicity of flow passages for a working fluid wherein each respective process fluid passage is located adjacent to a corresponding working fluid passage. There is also provided means for selectively controlling the direction of process fluid and/or working fluid on passage through the core element. It is also within the scope of the invention that the heat exchanger may be utilized to treat a plurality of different fluids or working fluids. Suitably the fluid flow apparatus includes an inlet component, an outlet component and the core element and it is the specific juxta position of these members that provides the means for selectively controlling direction of process fluid and/or working fluid through the core element.

8 Claims, 22 Drawing Sheets

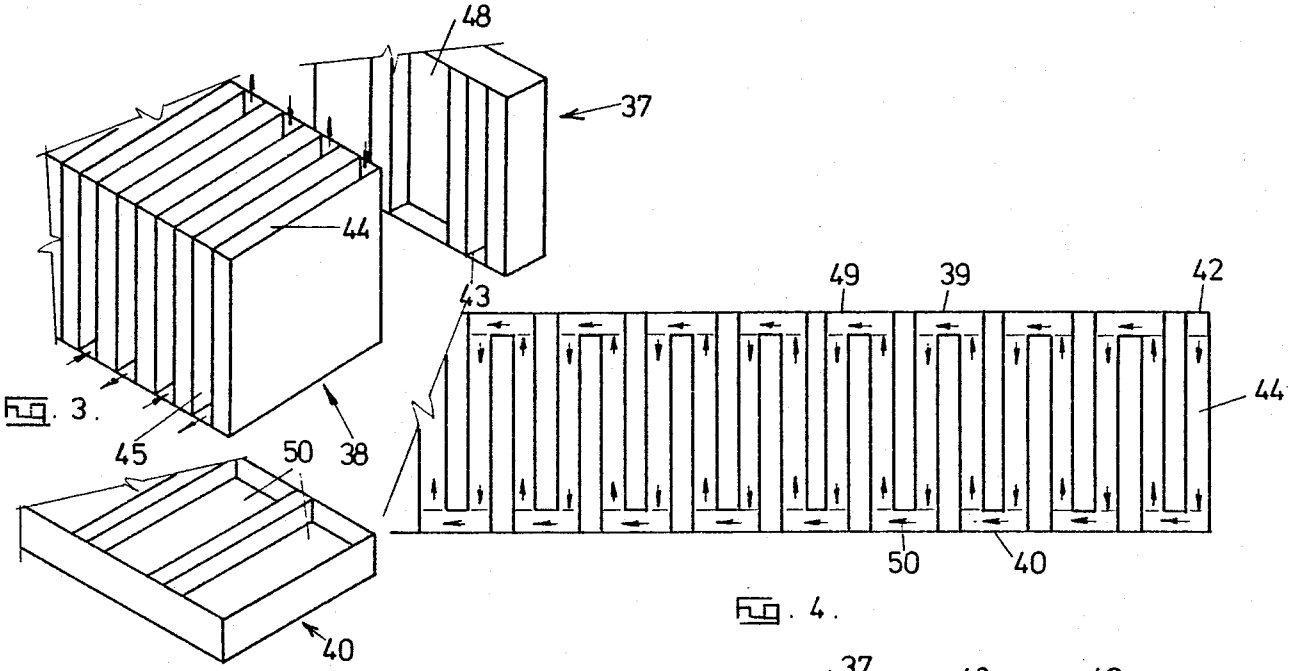
Fig. 3.
Fig. 4.
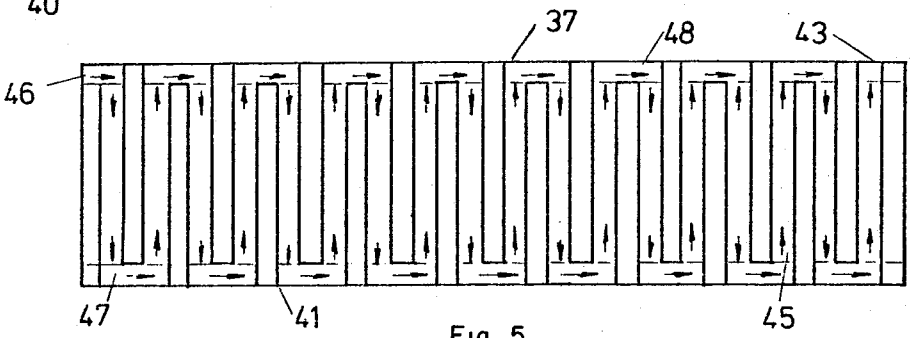
Fig. 5

74A
85
84
84D
84

92
90
91
89
80A
64
78
88
74A
83
63
77
74
82
77
78
80
65
83
80B
79A
79
81

134
136A 138
135
133
136
136

132
135
138
135
136
134
135
136

185
195
190

189

A
A
189

194
185
188
186
187
190
191
B
B
192
193

FLUID FLOW APPARATUS

This is a continuation of application Ser. No. 410,900 filed Aug. 24, 1982, now abandoned.

THIS INVENTION relates to fluid flow apparatus.

Primarily the fluid flow apparatus of the invention is concerned with flow therethrough of different fluids and while the invention will find a most convenient application as a heat exchanger, it will be appreciated that the invention should not be restricted to this example application.

Hitherto heat exchangers have comprised a number of different types which have all had various deficiencies which have included the requirement for constant maintenance because of complex construction and more importantly unequal distribution of fluid flow therein. This latter problem did not provide the desired characteristic of constant heat transfer over the available heat exchange or working area.

In one conventional heat exchanger commonly used in marine applications there was provided an array or bundle of tubes usually made from copper having relatively thin walls and a surrounding or external shell. Usually transmission fluid or oil was passed through the bundle or tubes while sea water was passed through the external shell so as to cool the transmission fluid or oil. While the bundle of tubes could be withdrawn from the external shell for cleaning or maintenance, it was found that this task was relatively time consuming and also that the external shell was liable to corrosion. It was also found that the velocity of the working fluid through the tube bundle was adversely affected if a blockage occurred in one or more tubes and this factor did not help in satisfactory operation of the heat exchanger because of the problem of unequal distribution of flow referred to above.

In relation to conventional plate type heat exchangers of the type shown in Specifications PCT/FR 79/00050 and European Patent Publication No. 0, 014,863 these were mainly concerned with treatment of gases at different temperatures and were specifically directed at ensuring that the gas flow direction into and out from the heat exchanger was kept constant so that the heat exchanger could be utilized for certain specific conditions such as for room ventilation and the like. Specification PCT/FR 79/00050 concerned a rather complicated method of construction which involved the interconnection of exchanger plates, segments provided with openings and closed segments in stacked relationship wherein the exchanger plates are formed from thin metal plate.

It has now been discovered in relation to fluid flow apparatus and in particular plate type heat exchangers that one may selectively control the flow directions of fluids under treatment upon flow through the plate type heat exchanger so as to provide a heat exchanger which may be used for different applications such as in the treatment of gases or liquids. Thus the fluid flow apparatus of the invention may be used in the food industry, as a vehicle radiator component in air conditioning or in engines or motors.

It is therefore an object of the invention to provide fluid flow apparatus which may be used to selectively control the flow directions of fluid passing through the apparatus. The fluid flow apparatus of the invention includes:

inlet means;

outlet means;

a core element having a plurality of flow passages for a process fluid and a multiplicity of flow passages for a working fluid wherein each respective process fluid passage is located adjacent to a corresponding working fluid passage; and means for selectively controlling the direction of process fluid and/or working fluid on passage through the core element.

The means for selectively controlling the direction of process fluid and/or working fluid may comprise the specific arrangement of process fluid passageways and/or working fluid passageways in the core element.

In another aspect the fluid flow apparatus may comprise an inlet component, outlet component, as well as the core element and it is the specific juxtaposition of these members that provides the means for selectively controlling direction of process fluid and/or working fluid.

In another aspect the fluid flow apparatus may comprise a return or diversion component, a core element and an inlet/outlet component and it is the specific juxtaposition of these members that comprises the means for selectively controlling direction of process fluid and/or working fluid.

The core element in relation to this invention may comprise any number of different constructions and arrangement of process fluid passages and working fluid passages.

Thus in one type there may be provided a core where each working fluid passage is located adjacent to a process fluid passage such that the flow direction of working fluid may be at right angles to the flow direction of the process fluid in their respective passages. In another situation the flow directions of both process fluid and working fluid in their respective passages may be substantially parallel. In this latter arrangement the respective flow directions may be the same or concurrent or may be opposite or countercurrent.

In each of the situations described above in the preceding paragraph it is preferred that the core be such that both process fluid and working fluid travel a serpentine or tortuous path throughout the core from their respective inlet to their respective outlet. This is because in this particular embodiment the process fluid and the working fluid are retained within the core and therefore within the effective working area of the apparatus a longer period of time than when compared to a single pass type apparatus wherein both of the fluids may only pass once through the core.

The core in one form may comprise a plurality of plates interconnected at their sides or ends by one or more attachment or spacer plates. The arrangement is suitably such that each plate is spaced from one another so as to form a series of substantially parallel flow passages wherein there are provided two separate arrays of flow passages so that flow of working fluid through one array of passages is separate to flow of process fluid through the other array of passages.

Preferably in the above arrangement each flow passage is substantially planar and of a rectangular shape.

The core may also comprise a plurality of core components or modules which are capable of being interfitted one with the other so as to provide a composite core which can be erected in situ so as to be appropriate for a particular location or job. The core may be built up by a vertical stacking or horizontal stacking arrangement.

It is also within the ambit of the invention to provide for a plurality of different process fluids or working fluids to be treated by the same core. Preferably however in this embodiment there are provided a plurality of different process fluids to be treated by a single working fluid.

The inlet and outlet for each fluid may be of any suitable type. Preferably however the inlet may include a casing divided into two separate housings by an appropriate partition wherein each housing has a series of slots with each slot communicating with an associated flow passage of the core. One housing may have an inlet conduit and the other housing have an outlet conduit.

If desired there also may be employed diversion plates to be placed adjacent one end of the core so as to divert or change the fluid direction of both process and working fluids. There also may be provided end or side plates or manifolds which when placed adjacent on an associated end or side of the core ensure that both process fluid and working fluid follow the desired serpentine or tortuous path described above.

In some cases the flow passages may have progressively increasing dimensions or cross sectional area from one end to the other so as to provide for change of state of fluids wherein gas may be converted to liquid or vice versa and even for change of state from solid to gas or vice versa.

It will also be appreciated in most cases sealing means may be required to seal off working fluid flow passages from adjacent process fluid passages. Normally such sealing means comprise continuous seals such as perimeter seals.

Reference may now be made to a preferred embodiment of the invention as shown in the attached drawings wherein;

FIG. 3 is a perspective view of the respective components of a third type of heat exchanger constructed in accordance with the invention;

FIG. 4 is a side view of the heat exchanger shown in FIG. 3 showing the flow path of process fluid;

FIG. 5 is a plan view of the heat exchanger shown in FIG. 3 showing the flow path of operating fluid;

FIG. 28A is a cross sectional view of the finger seals used in FIG. 28 along line A—A;

Figure 1:
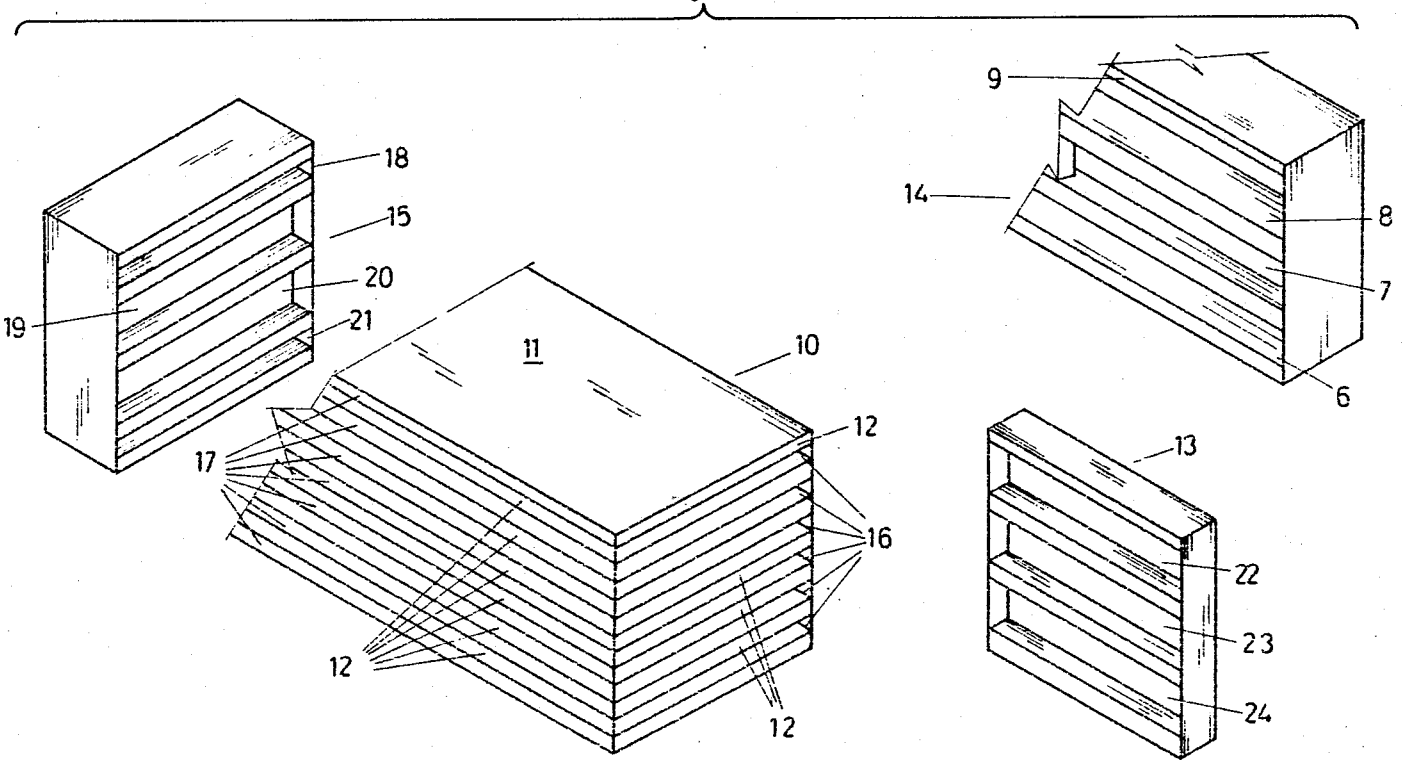
FIG. 1 is a view of the respective components of a first type of heat exchanger constructed in accordance with the invention.

In FIG. 1 there is shown core 10 comprising a plurality of plates 11 interconnected by webs 12 to form a series of parallel flow passages 16 and a multiplicity of flow passages 17 extending at right angles to passages 16. There is also shown process fluid inlet/outlet manifold 15, operating fluid inlet manifold 14 and process fluid return cover or manifold 13. Manifold 15 has inlet 18 for process fluid connectable to any suitable pipe or conduit and outlet 21. Process fluid flows through inlet 18, along a corresponding passage 16 of core 10, around into the second passage 16 via recess 22 in cover 13, around into the third passageway 16 via recess 19 in manifold 15, and subsequently through recess 23 of cover 13, recess 20 of manifold 15, recess 24 of cover 13 and out through outlet 21 after passage through the corresponding flow passages 16 in core 10 before exiting through outlet 21.

Operating fluid enters through inlet 9 of manifold 14, through top passageway 17 in core 11, through a recess in an outlet operating fluid manifold similar to manifold 14 but arranged in opposite manner (not shown for clarity) and then through recesses 8, 7 and 6 and out through an outlet in the operating fluid outlet manifold which is not shown after travel through aligned passageways 17 in core 10.

Figure 2:
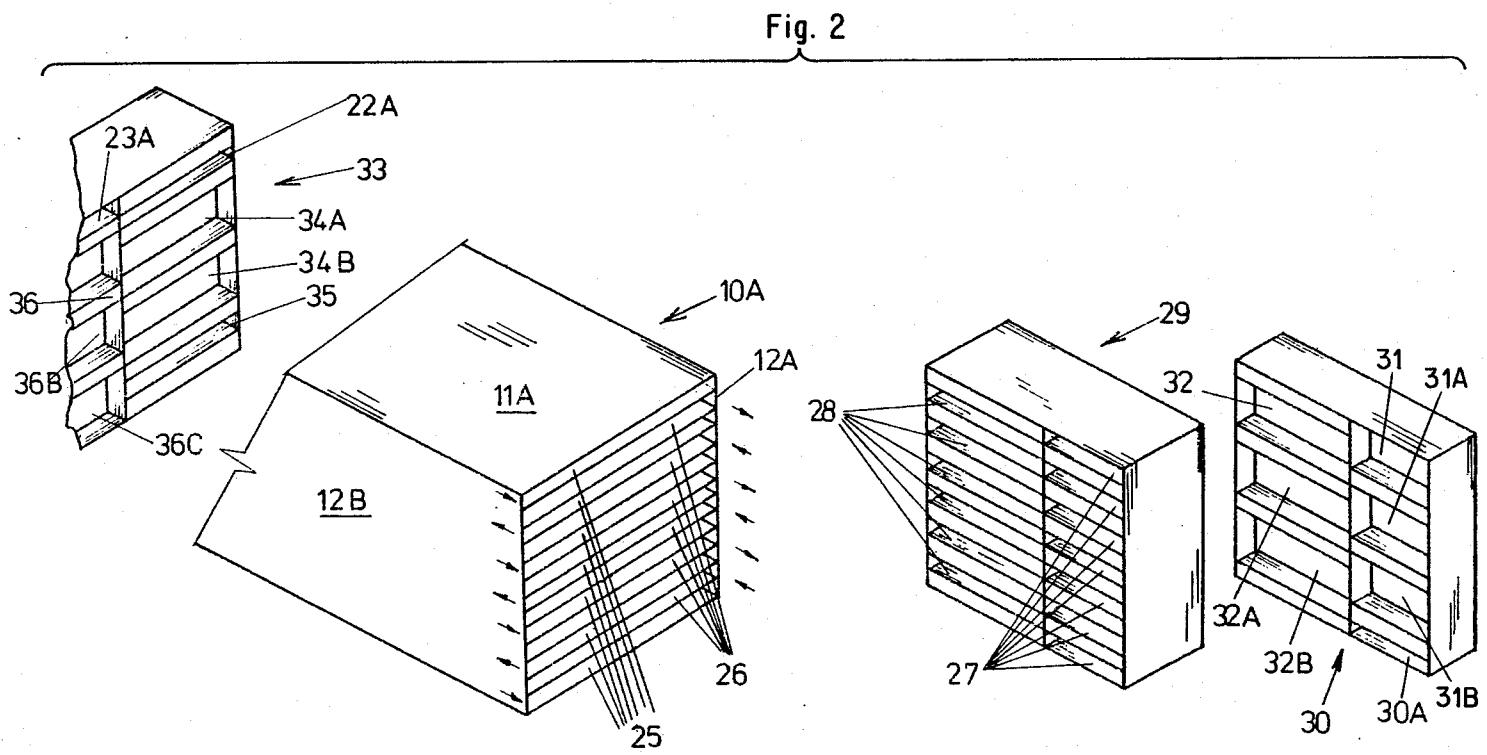
FIG. 2 is a view of the respective component of a second type of heat exchanger constructed in accordance with the invention.

In FIG. 2 there is shown core 10A having a series of parallel operating fluid flow passageways 25 and a multiplicity of parallel process fluid passageways 26. Core 10A comprises plates 11A interconnected by webs 12A. There is also shown manifold 33, diversion chamber or member 29, and manifold 30. As shown by the arrows in relation to core 11A, operating fluid enters through inlet 23A of manifold 33, along top passageway 25, through top passageway 27 in diversion member 29, through recess 31 in manifold 30, and through second passageway 25 until an additional diversion chamber or member (not shown) is encountered which is similar to member 29. This additional diversion member causes operating fluid to then travel into recess 36 and subsequently through recess 31A in manifold 30, recess 36B in manifold 33, recess 31B in manifold 30, recess 36C in manifold 33 and finally out through outlet 30A in manifold 30 along corresponding passageways 25 in core 10A and passageways 27 in diversion chamber 29. The direction of the flow path of the operating fluid is shown by the arrows included in side panel 12B.

In a similar manner process fluid enters through inlet 22A, along top passageway 26, top passageway 28 in diversion member 29, through recess 32 in manifold 30 and subsequently through recess 34A in manifold 33, recess 32A in manifold 30, recess 34B in manifold 33, recess 32B in manifold 30 and finally out through outlet 35 in manifold 33 after travelling through aligned passageway 26 in core 10A and 28 in diversion chamber 29. The direction of the flow path of the process fluid is shown by the arrows aligned with flow passages 26.

In relation to FIGS. 3, 4 and 5 there is shown core 38 including vertically oriented passageways 44 and horizontally oriented passageways 45. The direction of flow of process fluid is shown by the arrows aligned with passages 45 and the direction of flow of operating fluid is shown by the arrows aligned with passages 44. There is also indicated upper and lower manifolds 39 and 40 and opposed side manifolds 37 and 41. Manifold 37 includes outlet 43 and a plurality of recesses 48. Manifold 37 also includes inlet 46. Manifold 41 includes a plurality of recesses 47. Manifold 39 includes inlet 42 and a plurality of recesses 49 while manifold 40 includes a plurality of recesses 50. Manifold 39 also includes an outlet (not shown). As shown in FIG. 4, process fluid flows through inlet 42 and passageways 44 via recesses 50 and 49. As shown in FIG. 5, operating fluid flows through inlet 46 and passageways 45 via recesses 47 and 48 to outlet 43.

In FIG. 6–9, there is illustrated another type of heat exchanger comprising core 51, operating fluid inlet-outlet manifold 52, return manifold 53, process fluid inlet-outlet manifold 54, and return manifold 55A.

Figure 9:
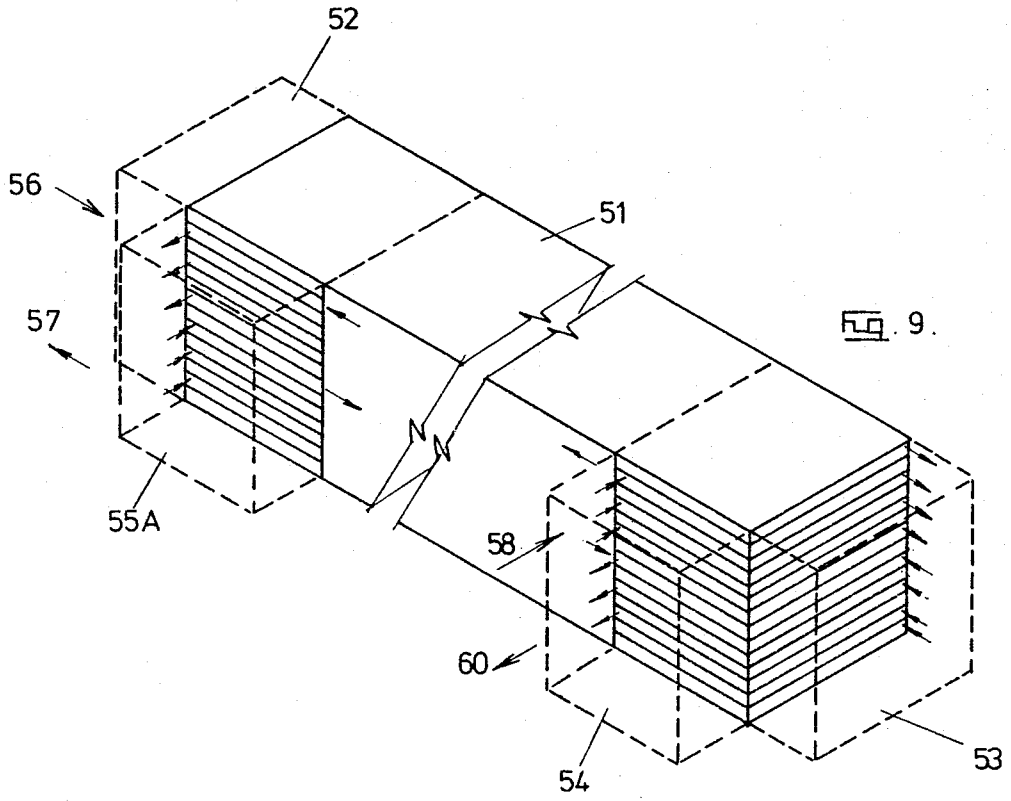
FIG. 9 is a perspective view of the heat exchanger shown in FIG. 6 with the manifolds shown in FIG. 7 and 8 in position.

As best shown in FIG. 9, manifolds 52 and 55A are located as shown in relation to core 51 so that flow passageways 59 of manifold 55A are oriented across or are normal to flow passageways 55B of manifold 52. In a similar manner manifolds 53 and 54 are located as shown in relation to core 51 so that flow passageways 59A of manifold 54 are orientated normal to flow passageways 55C of manifold 53.

When the manifolds 52 and 55A and 53 and 54 are positioned as described above in conjunction with core 51, the flow paths of both operating fluid and process fluid have the directions indicated by the arrows in FIGS. 6–9.

Thus in relation to the process fluid, it enters the heat exchanger through inlet 58 through passageways 59A, then travels through aligned passageway in core 51 (not shown) to passageways 59 in manifold 55A then back into core 51. The process fluid then flows through aligned passageways (not shown) with flow passages 59 and subsequently into passageways 59A of manifold 54 which are aligned with outlet 60.

Figure 6:
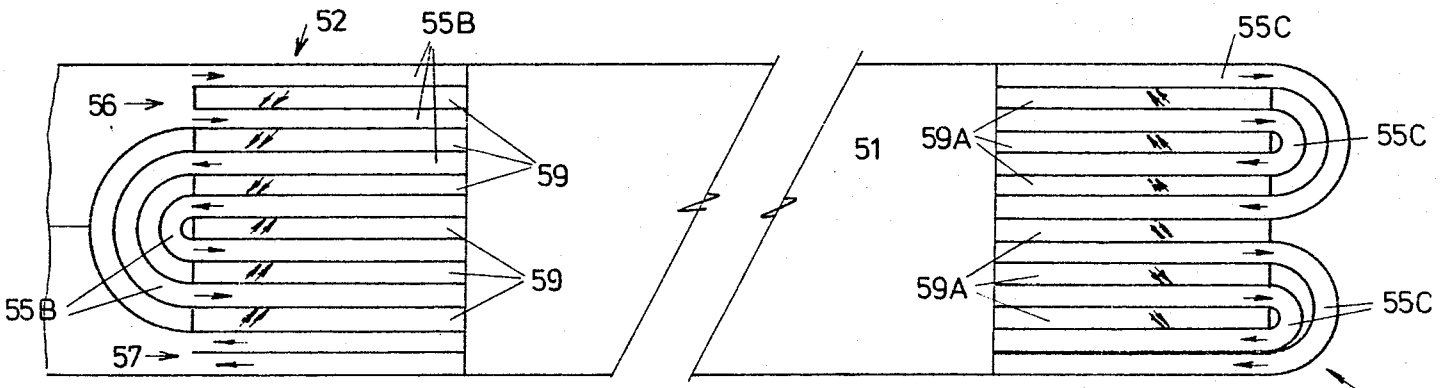
FIG. 6 is a side view of a fourth type of heat exchanger constructed in accordance with the invention.
Figure 8:
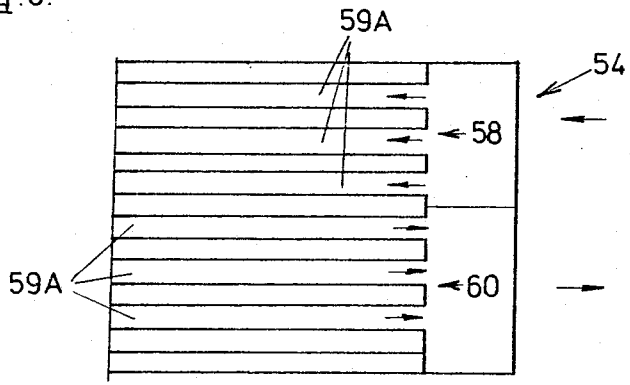
FIG. 8 is a side view of a process fluid inlet-outlet manifold for the heat exchanger in FIG. 6.
Figure 7:
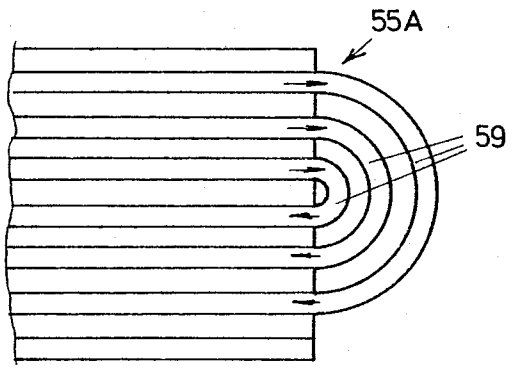
FIG. 7 is a side view of a process fluid return manifold for the heat exchanger shown in FIG. 6.

In regard to the operating fluid, this travels from inlet 56 in manifold 52 through aligned passageways 55B, through corresponding passageways (not shown) of core 51, then through passageways 55C of manifold 53 and back into core 51 along appropriate passageways (not shown) to passages 55B in manifold 52 and back through core 51 to passageways 55C and finally to the outlet 57 after final passage through core 51 as shown in FIG. 6.

Figure 10:
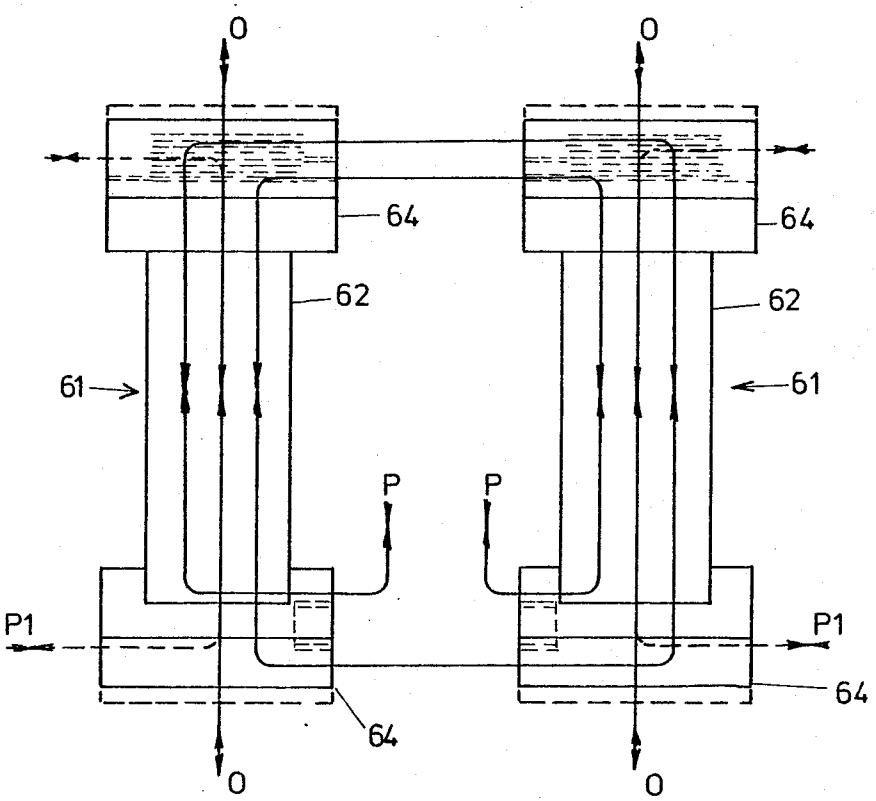
FIG. 10 is a schematic view of a heat exchanger constructed in accordance with the invention showing a side by side integral system which may have further heat exchangers incorporated therein by horizontal stacking.

In the assembly shown in FIG. 10 is a side by side assembly of heat exchanger units 61 comprising cores 62, and inlet/ outlet manifolds 64. The direction of operating fluid flow path is shown by the letter O and the flow path of process fluid is shown by the letter P. Further units 61 may be incorporated in the system on either side of the assembly shown so as to form a heat exchanger formed by a plurality of units 61 by horizontal stacking. Alternative flows for process fluid are shown in dotted outline and indicated by letters P1.

Figure 11:
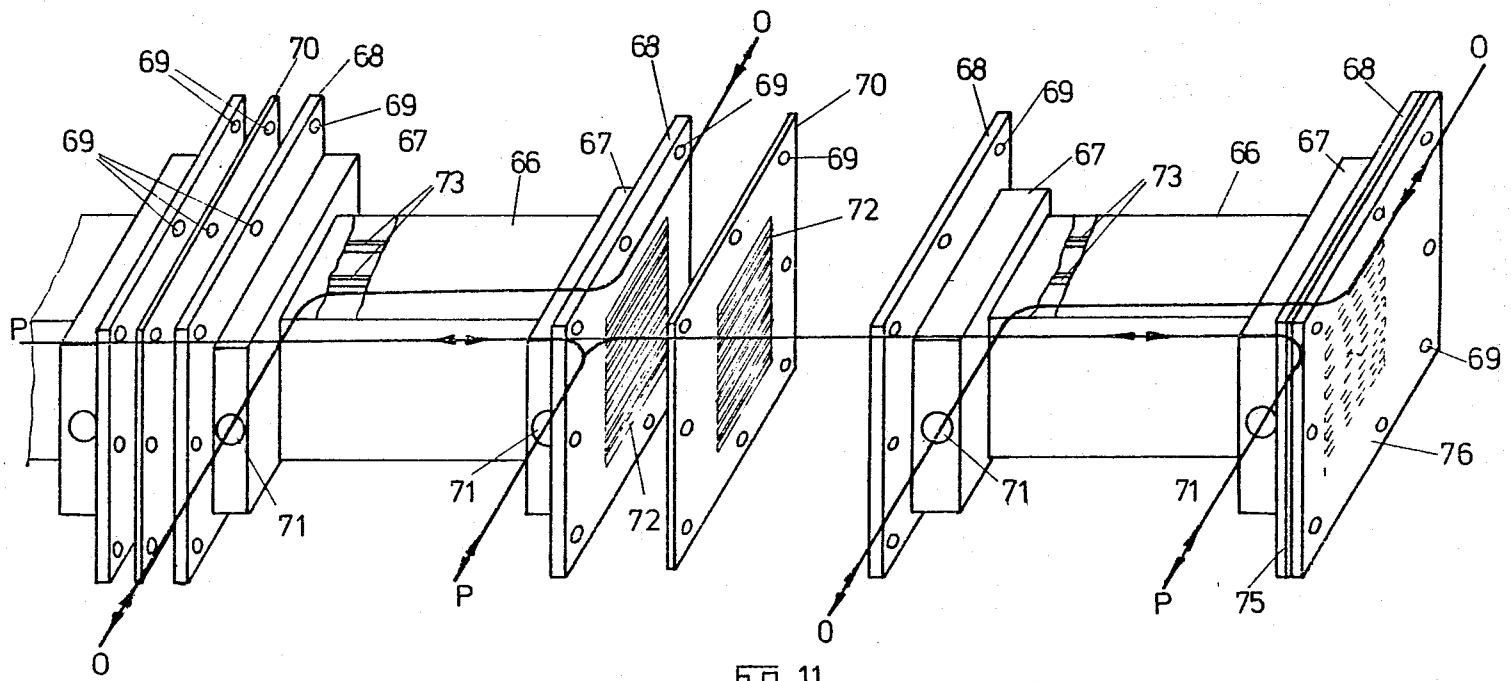
FIG. 11 shows a heat exchanger constructed in accordance with the invention showing a vertical stacking arrangement of two or more heat exchanger units.

FIG. 11 shows a heat exchanger formed by a vertical stacking arrangement wherein units formed by cores 66, inlet/outlet modules 67, end plates 68 and gaskets 70 are interconnected as shown by bolts (not shown) or other fasteners extending through attachment apertures 69. Inlet/outlet ports are indicated by reference numerals 71 and each end plate 68 includes flow slots 72 as does gasket 70. A closure plate 76 completes one end of the assembly. There are also included strengthening rods 73 for cores 66 and gasket 75 for closure plate 76. One or more partitions (not shown) may be incorporated in modules 67 if a multifluid arrangement is envisaged. The letters P and O as in FIG. 10 show flow path directions of process fluid and operating fluid respectively.

Figures 12, 12A:
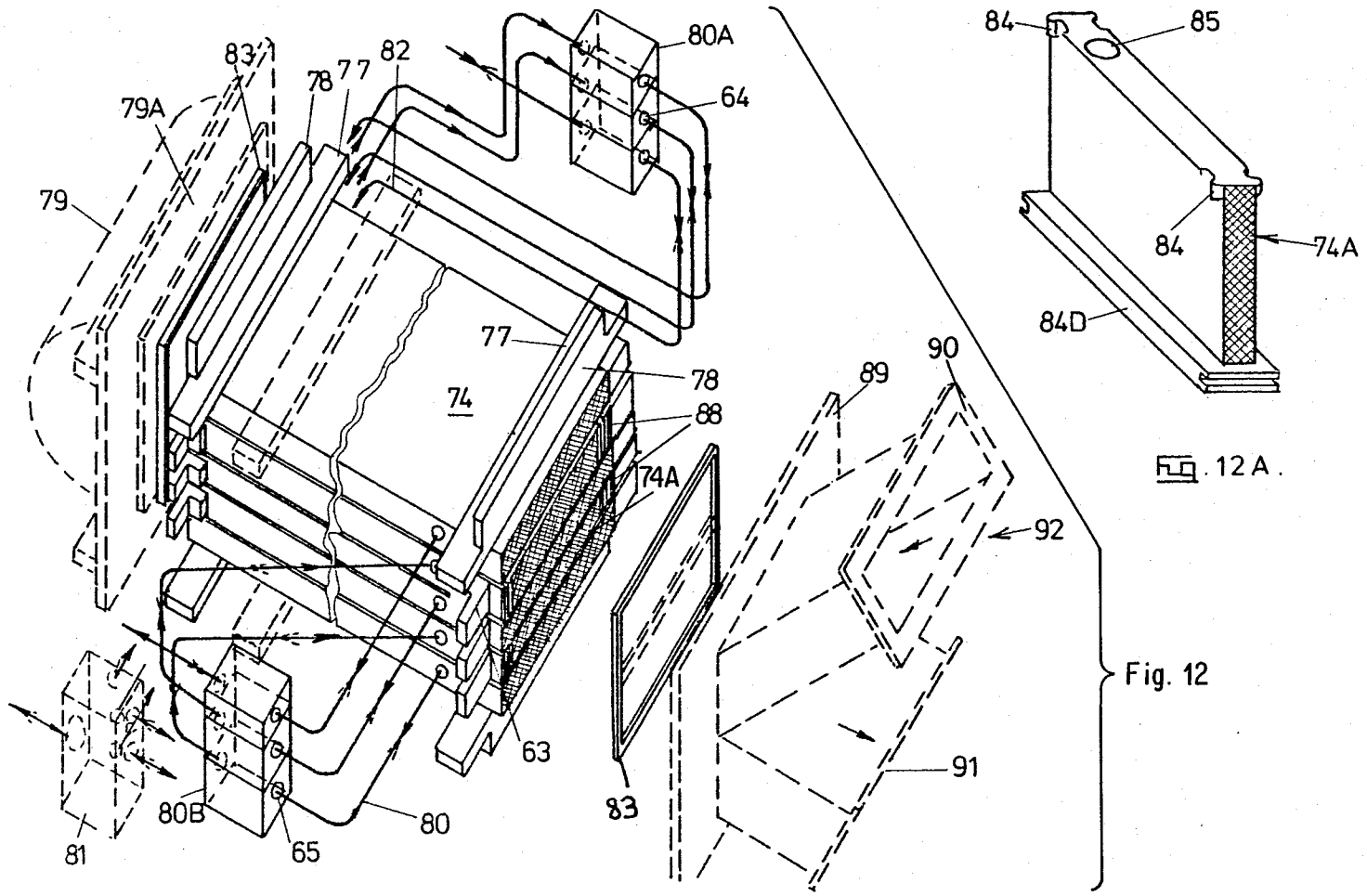
FIG. 12 shows a heat exchanger constructed in accordance with the invention comprising a plurality of modular core elements.
FIG. 12A is a detailed view of an individual core element.

In FIG. 12 there is shown a core comprising a plurality of core plates 74 and 74A in vertical stacking arrangement. Each core plate 74 and 74A is hollow having diagonally opposed entry ports 85. The arrangement shows end core plates 74 and intermediate core plates 74A which are provided with integral projections 63. Stiffening rods 82 are incorporated between the core plates. There is also shown locking plates comprising base flange 77 and upright flange 78 which are located at the top and bottom of the core plate assembly on opposite sides thereof as shown.

In one direction fluid may pass through inlet module 80A and follow the path shown through the assembly of core plates 74 and 74A. Fluid in this case passes sequentially through ports 64 of inlet module 80A and ports 65 of outlet module 80B. Module 80A of course may be an outlet module and module 80B may be an inlet module and this is indicated by the arrowheads in dotted outline. In this case only one fluid flow path is shown for convenience. 81 designates an alternative type of module in dotted outline for an alternative direction in the flow path. Hoses 80 interconnect ports 85 to modules 80A and 80B through ports 64 and 65. Modules 80A and 80B may be replaced by ducts (not shown) if required.

In dotted outline there is shown outlet/inlet module 92 comprising inlet/outlet ports 90 and 91 and end plate 89. There is also shown gasket 83 which engages in grooves 88 in the core assembly formed by plates 74 and 74A. As better shown in FIGS. 12A and 12B there is also provided gasket location lugs 84 which engage with corresponding sockets 84B of peripheral seals 84D releasably attached to plates 74A. Gasket 83 is supported on surfaces 84A of end plates 74 and surface 84C as shown. Intermediate plates 74A are provided with attachment lugs 63 which are spaced from end plate 89 but attached thereto by bolts (not shown) or other fasteners. Return module 79 is provided with end plate 79A and manifolds 79 and 92 in dotted outline represent a flow path for an appropriate working fluid.

Figure 12B:
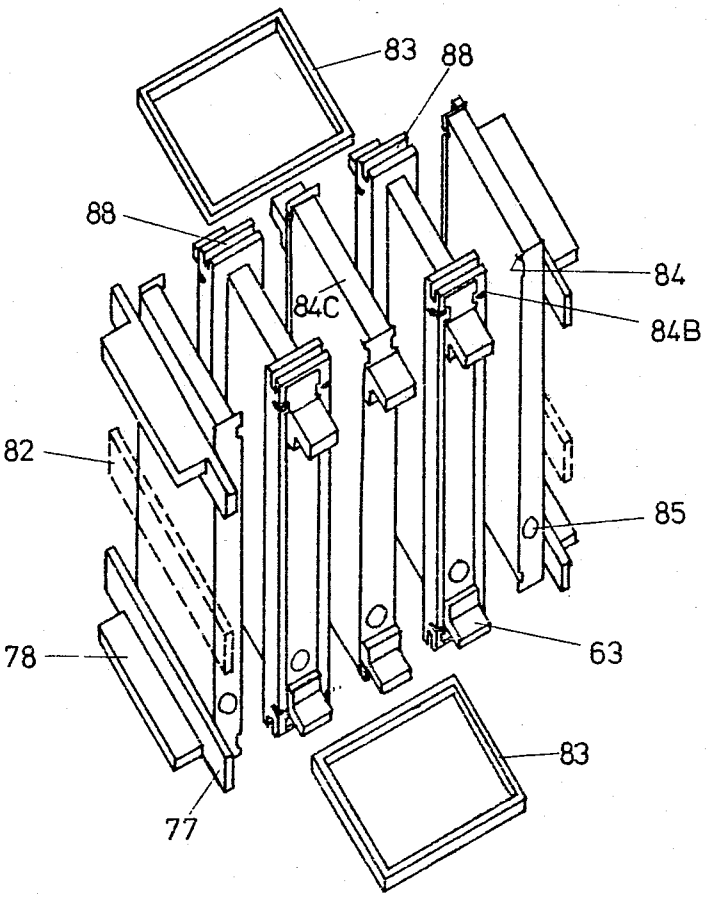
FIG. 12B is an exploded view of the heat exchanger shown in FIG. 12.

The arrangement shown in FIGS. 12–12B is suitable for the food industry as it is easily dismantled to its component parts for cleaning as will be apparent.

Figure 13:
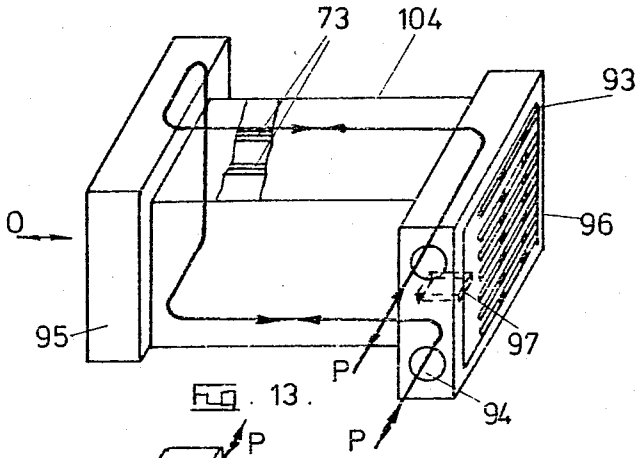
Figure 14:
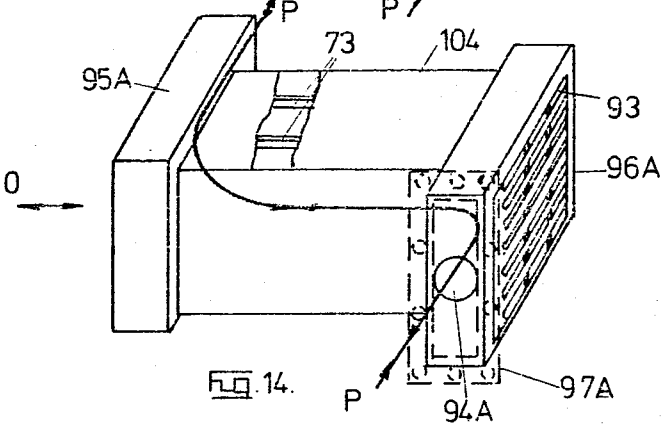
Figure 19:
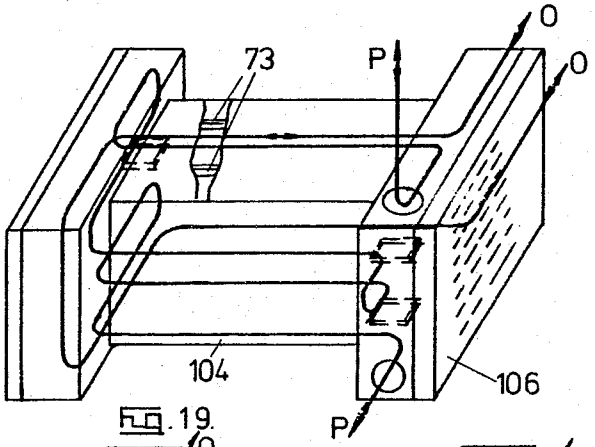

In the exchanger units shown in FIGS. 13 and 14 alternative flow paths of operating fluid (O) and process fluid (P) are shown. In FIG. 13 operating fluid passes through modules 95 and 96 exiting through slots 93. Process fluid passes through modules 95 and 96 through exit ports 94 located in module 96. In FIG. 14 process fluid passes through inlet/outlet port 94A in module 96A and passes through inlet/outlet port (not shown) in module 95A. Attachment plate 97A in dotted outline is also shown adjacent port 94A.

Figure 15:
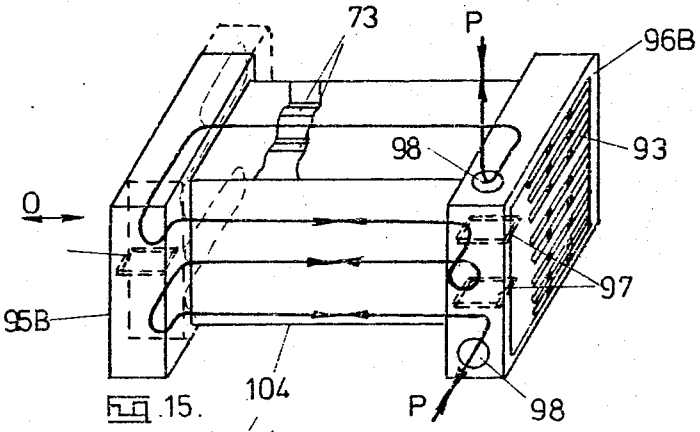
FIGS. 13–22 show various forms of heat exchanger units constructed in accordance with the invention illustrating differing flow directions.

In FIG. 15 different flow paths of process fluid are shown to those in FIGS. 13–14. Access ports 98 are shown and partitions 97 in modules 95B and 96B are also shown.

Figure 16:
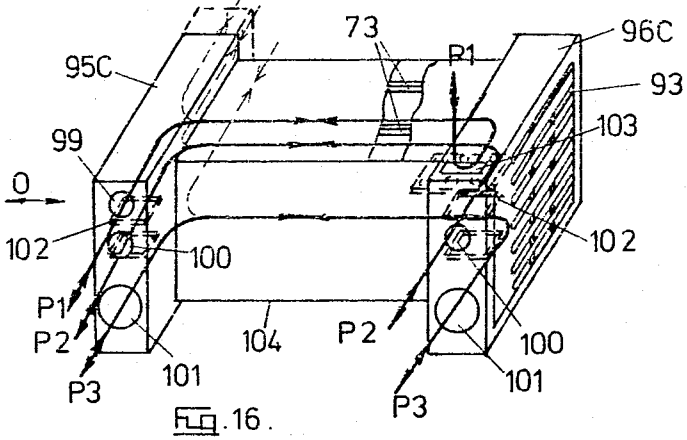

In FIG. 16 a multiplicity of process fluids indicated by arrows P1, P2 and P3 may have the flow paths indicated passing through entry ports 99, 100 and 101. Partitions 102 located in modules 95C and 96C are also shown. P1 may exit through port 103. Alternative flow paths are also shown in dotted outline.

In each of FIGS. 13–16 strengthening rods 73 are included in each unit having core elements 104.

Figure 20:
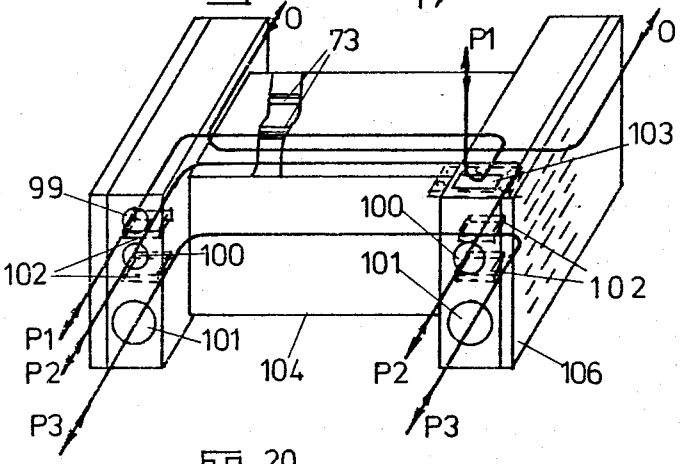
Figure 17:
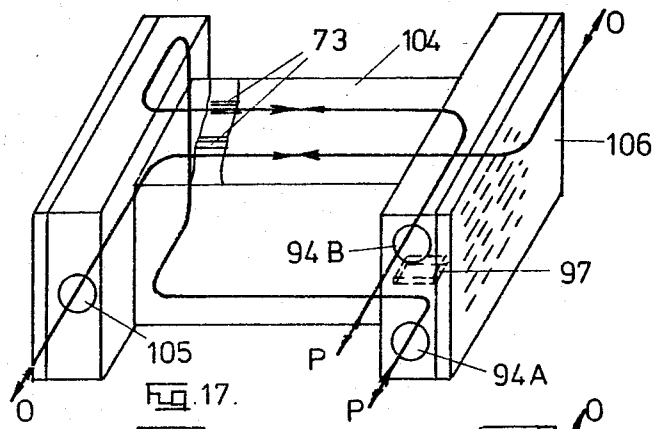
Figure 18:
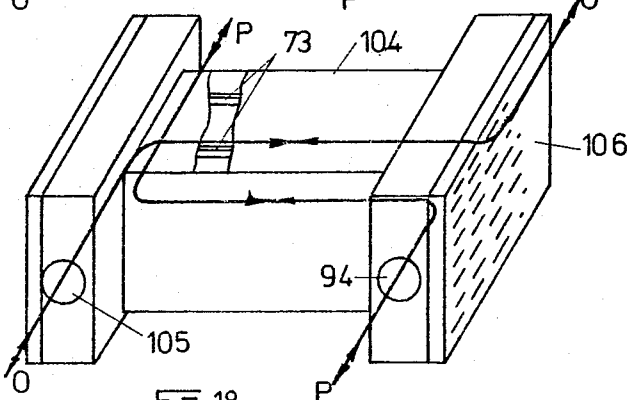

In FIGS. 17–20 different flow paths again are illustrated for process fluid (P) and operating fluid (O). Similar reference numerals are used with 94, 94A and 94B indicating access ports for process fluid and 105 access ports for operating fluid. Partitions 97 are again incorporated and a plurality of process fluids shown by letters P1, P2 and P3 divided by partitions 102 and described above in FIG. 16 are shown in FIG. 20. End plates 106 are attached to each adjacent module.

The reference numerals for the respective modules in FIGS. 16–20 are omitted for convenience.

Figure 21:
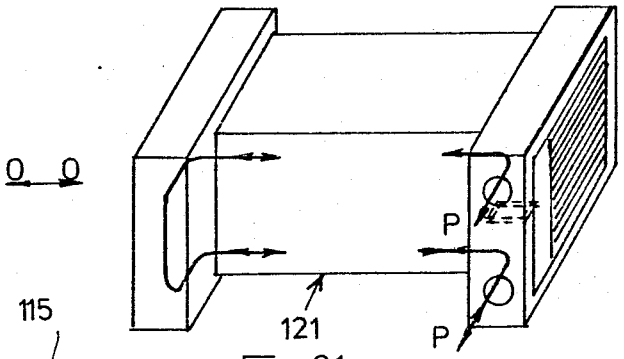
Figure 22:
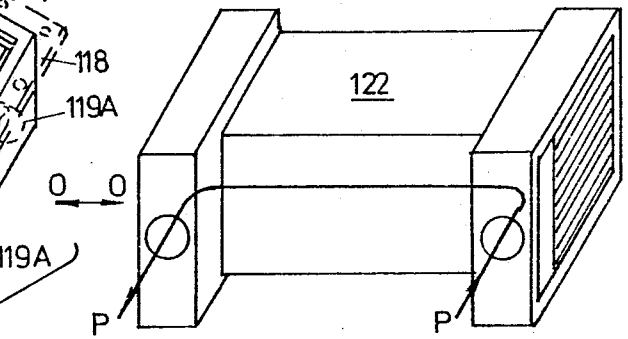

FIGS. 21–22 show still further alternative flow paths for process fluid P and operating fluid O. The construction of heat exchangers 121 and 122 will not be described in detail as it is similar to those previously described in FIGS. 13–20. The flow path for operating fluid is a single pass in each case.

Figure 23:
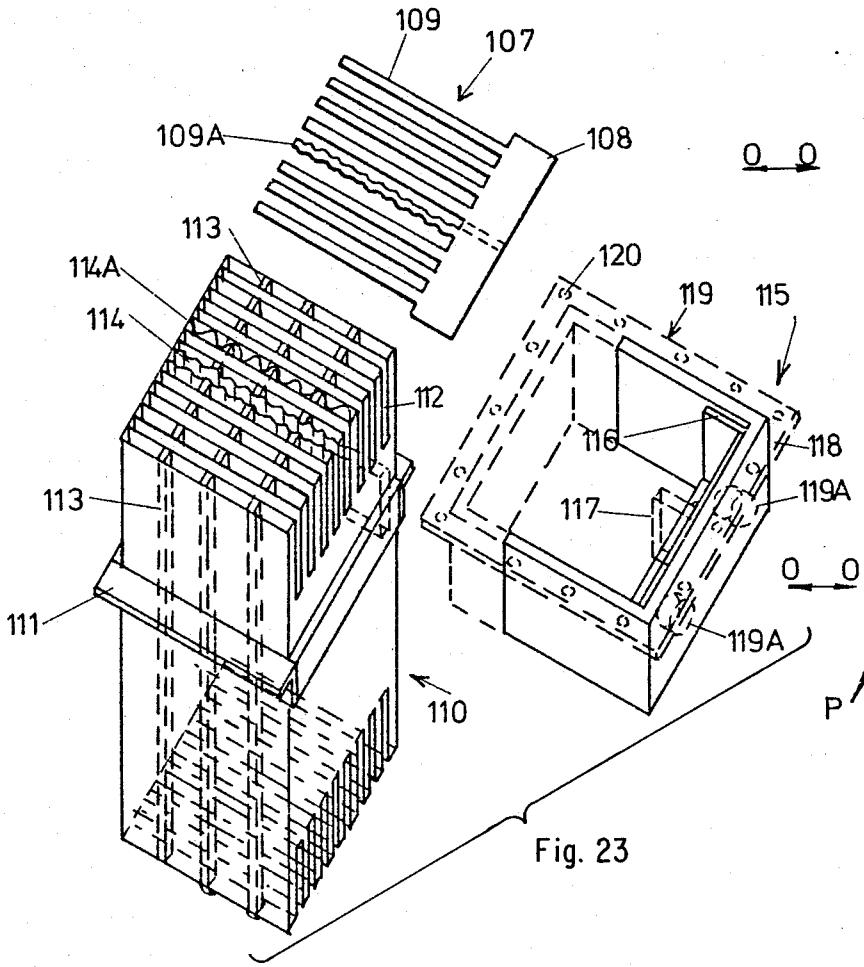
FIG. 23 is a perspective view of a heat exchanger constructed in accordance with the invention showing a specific type of sealing means.

In FIG. 23 there is shown a core element 110 with end slots 112 adapted to receive sealing member 107 having finger seals 109 mounted on base 108 which mate in slots 112. If desired finger seals 109 may have a corrugated profile as shown by 109A adapted to mate in corrugated end slot 114. There is also shown corrugated inserts 114A. Core 110 includes longitudinal strengthening ribs 113 and peripheral stabilizer or strengthening member 111. There is also shown module 115 having partition 117 if desired in dotted outline and flange 116 to support sealing member 107. Module 115 may have an alternative shape 119 shown in dotted outline having peripheral flange 118 and attachment apertures 120. Module 119 may include inlet/outlet ports 119A.

Figure 24:
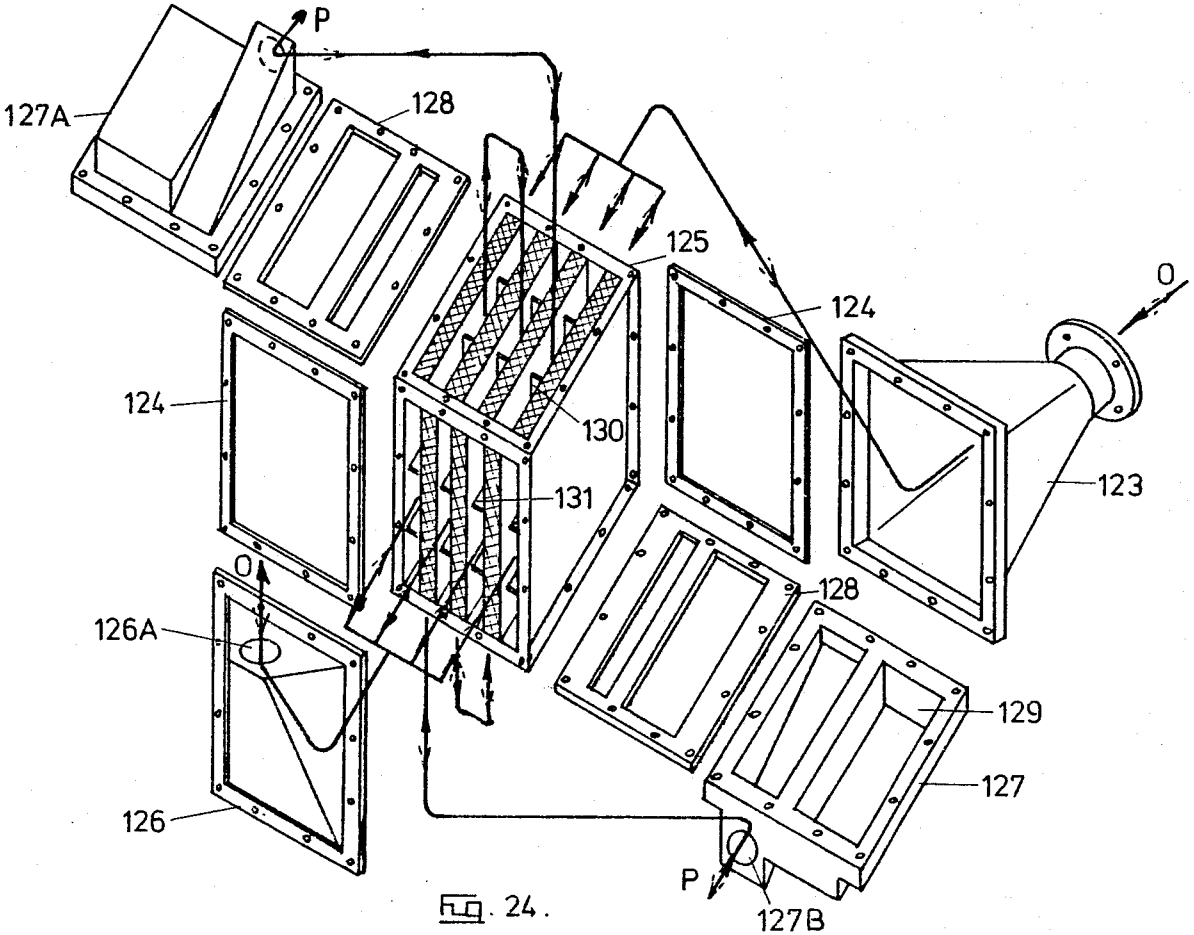
FIG. 24 is a perspective view of a heat exchanger constructed in accordance with the invention suitable for the separation of fats and oils from emulsions showing an exploded view of the respective components thereof.

FIG. 24 shows a cross flow arrangement with operating fluid entering through inlet module 123 passing through core 125 in the direction shown through strengthening ribs 131 and out through outlet module 126. Process fluid enters through inlet module 127 through gasket 128 and then through core 125 at right angles to the operating fluid through strengthening ribs 130 and out through outlet module 127A after passing through gasket 128. There is also shown seals 124 and diversion recesses 129 in modules 127 and 127A. Module 127 has port 127B and module 126 has port 126A.

Figures 25, 26:
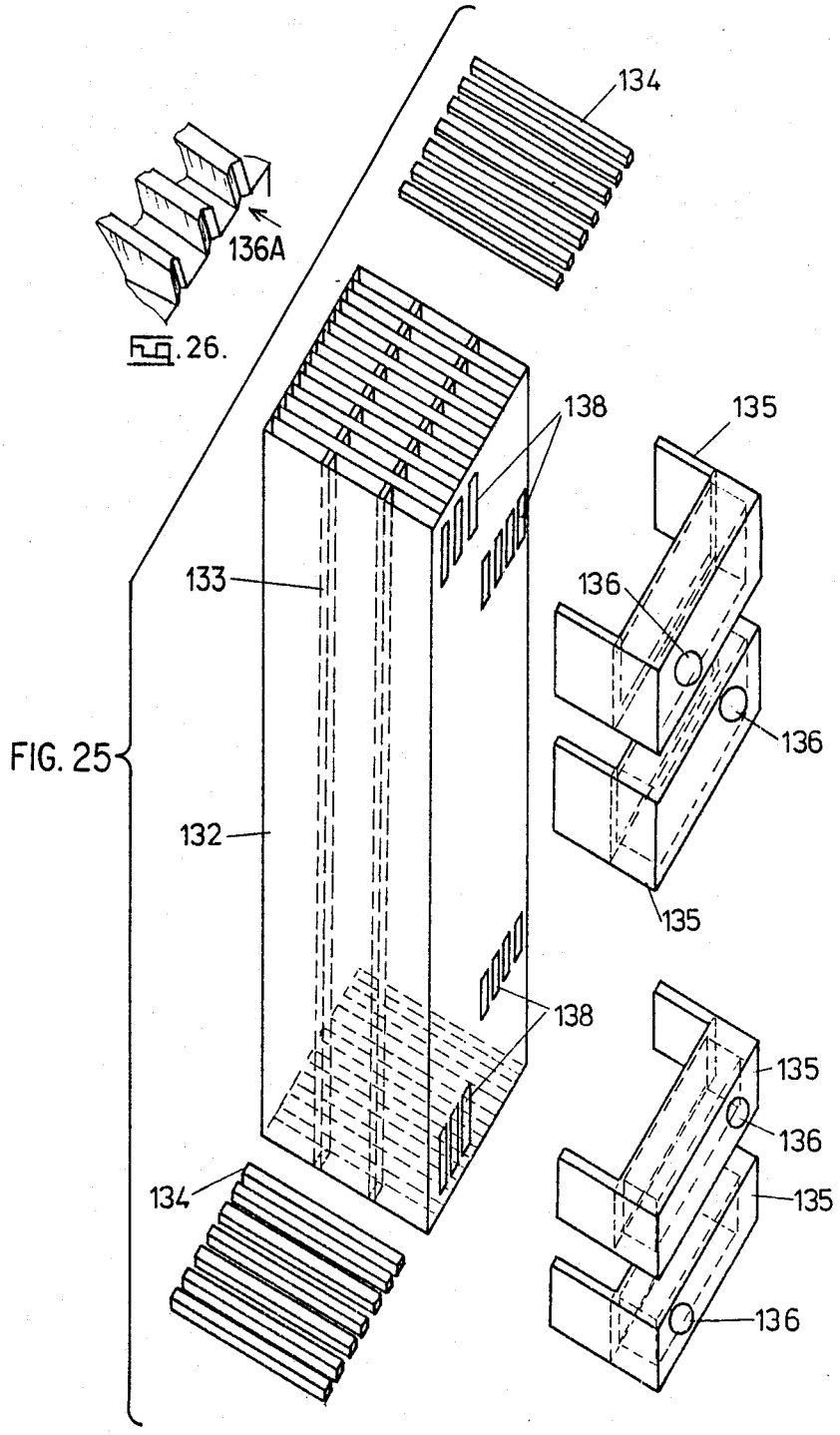
FIG. 25 is an exploded view of a modified form of heat exchanger constructed in accordance with the invention showing vertical stacking of inlet/outlet components.
FIG. 26 is a detailed view of an alternative form of sealing means to that adopted in FIG. 25.

FIG. 25 shows another form of sealing means for a heat exchanger constructed in accordance with the invention. There is shown core 132 having strengthening ribs 133 and finger seals 134 which are to be located in recesses (not shown for convenience) in each end of core 132. In this embodiment each rib 133 is located below the plane of the core 132 to accommodate seals 134. Module components 135 having fluid access slots 136 are provided at each end of core 132 and shown. Core 132 has access slots 138 aligned with ports 136.

FIG. 26 shows an alternative sealing arrangement where an end fold seal or seam seal 136A may be used instead of finger seals 134.

Figure 27:
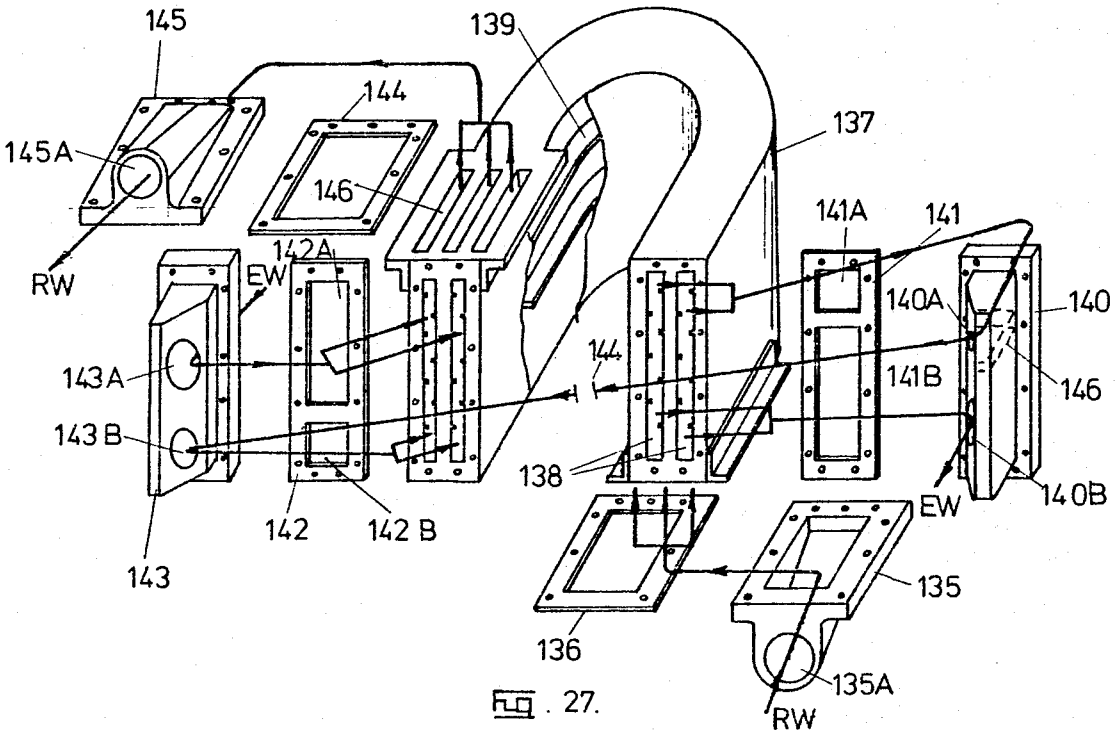
FIG. 27 is an exploded view of a heat exchanger constructed in accordance with the invention and suitable for an outboard motor.

In a specific embodiment of the invention, FIG. 27 shows a heat exchanger suitable for an outboard motor. Raw water or sea water (RW) enters through port 135A of inlet module 135 as shown through slots (not shown) in the undersurface of core element 137, out through slots 146 in the top surface of core element 137, and out through port 145A of outlet module 145. On the other hand engine water (EW) enters inlet module 143 through port 143A, through port 142A of gasket 142, into core element 137 through slots 138, out of core element 137 through slots 138, through port 141A of gasket 141, through rear port (not shown) of module 140 above partition 146 and out through port 140A, through one-way valve 144, through port 143B of module 143, through port 142B of seal 142 through slots 138 of core element 137 and finally through port 141B of gasket 141 which is below partition 146 and out through outlet port 140B of module 140. Slots 138 of core element 137 are separated from each other providing discrete flow channels (not shown) in core 137. There is also included gaskets 136 and 144 as shown. The circulation of engine water (EW) from the top of core element 137 to the bottom thereof through one way valve 144 is accomplished through a venturi action as shown caused by the pressure of the engine water flow. There is also included wall supports or strengthening ribs 139 of core element 137.

Figure 28:
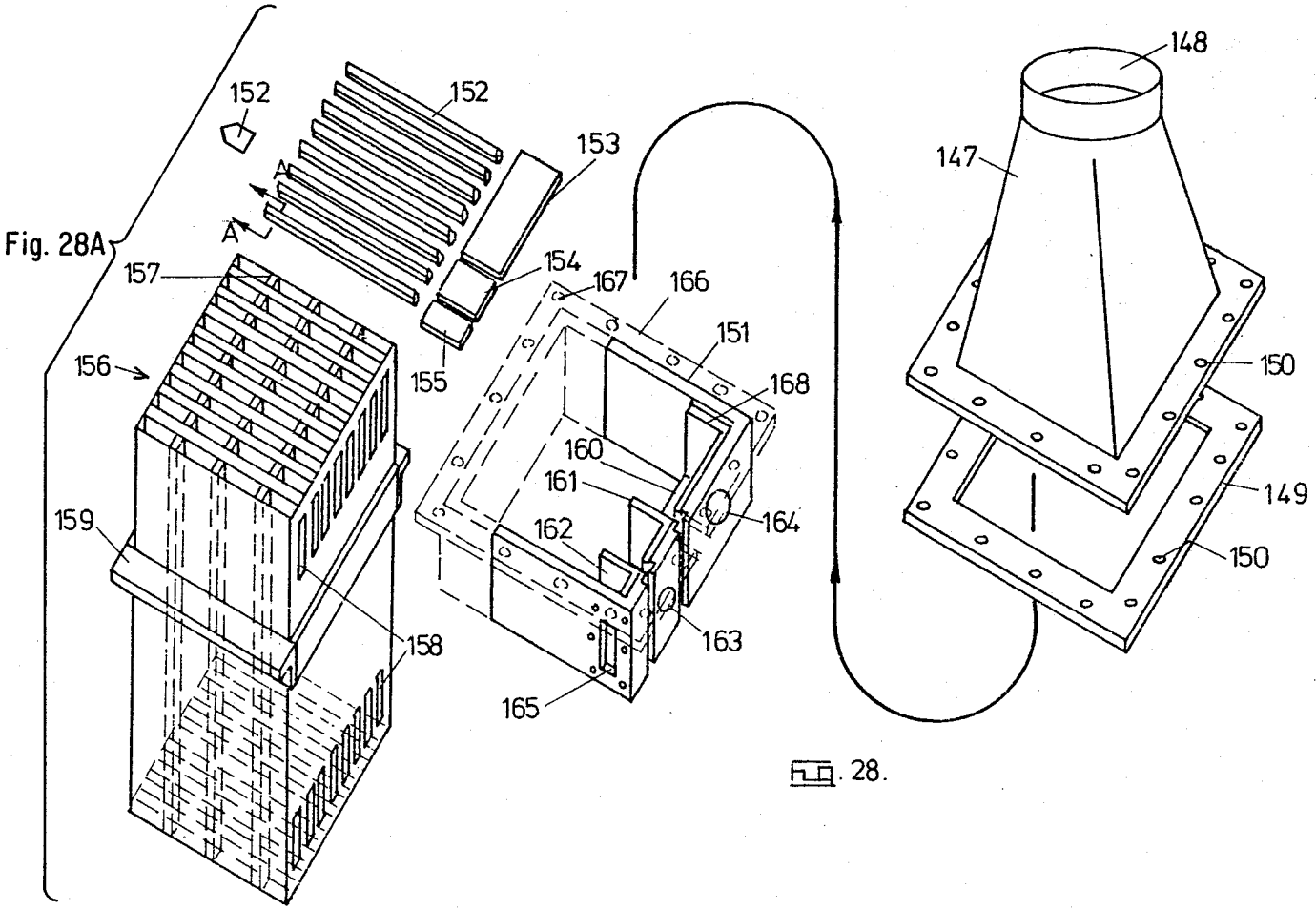
FIG. 28 is an exploded view of a heat exchanger constructed in accordance with the invention and showing incorporation of partitioned heat exchange modules for a plurality of different process fluids flowing through the core element.

In FIG. 28 there is shown core element 156 having entry slots 158, flow dividing or reinforcing rods 157 and peripheral stabilizer or support 159. Finger seals 152 having a cross section as shown in FIG. 28A located in recesses in the top of core element 156 wherein rods 157 are located below the end plane of core element 156. Plates 153, 154 and 155 function as cover plates and are supported on ledge 168 of manifold 151. Manifold 151 is suitable for multifluid applications and for this purpose has partitions 161 and 162 and ledge 160 as shown. There is also shown entry ports 163, 164 and 165.

Inlet/outlet module 147 having entry port 148 and attachment apertures 150 may be attached to end plate 166 of manifold 151 as shown. End plate 166 may have apertures 167 which may be aligned with apertures 150 of module 147 and gasket 149 for attachment purposes.

Figure 29:
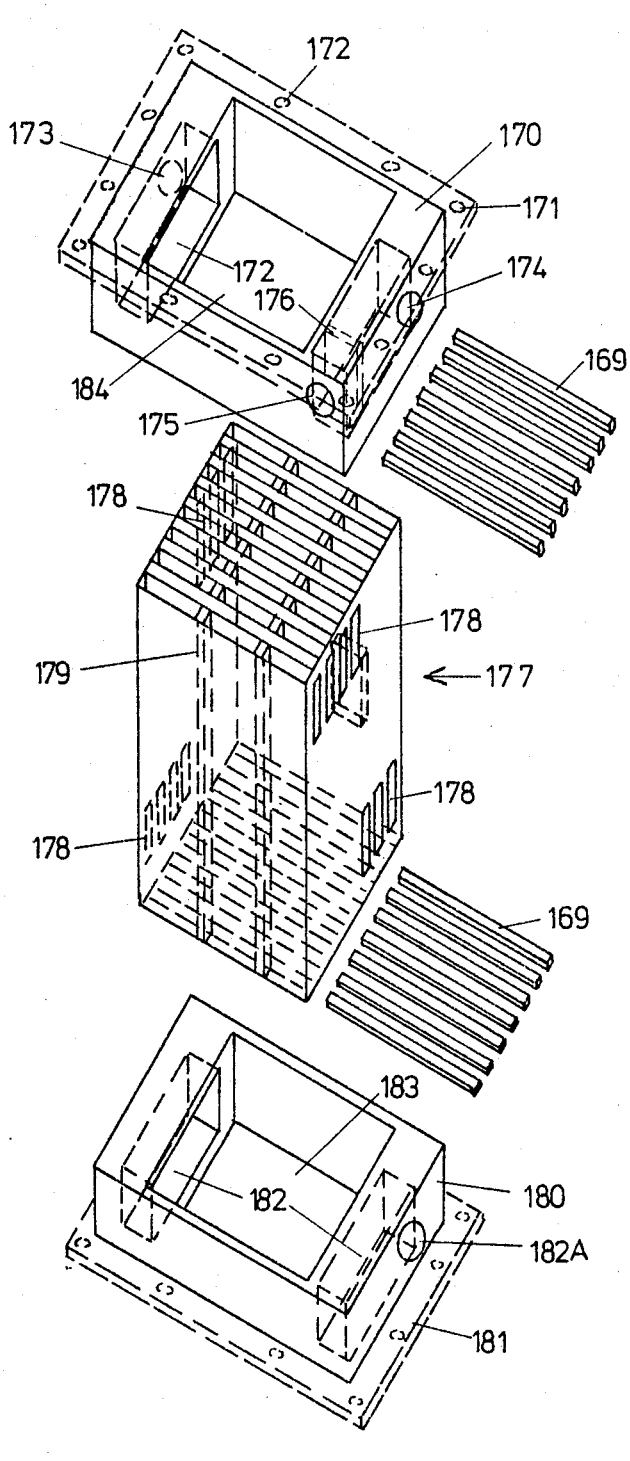
FIG. 29 is an exploded view of yet another type of heat exchanger constructed in accordance with the invention suitable for the automotive industry.

Another type of heat exchanger constructed in accordance with the invention is shown in FIG. 29. Finger seals 169 locate in core element 177 as described previously. Module 170 has end plate 171 with attachment apertures 172 and is provided with entry slot 184 and access ports 173, 174 and 175. Partition 176 is provided between ports 174 and 175. Core element 177 is provided with longitudinal reinforcing rods or dividers 179. There is also provided entry slots 178.

Module 180 has entry slot 183 and recesses 182. There is also shown in dotted outline end plate 181. One recess 182 has incorporated an access port 182A.

Figures 30, 31, 32:
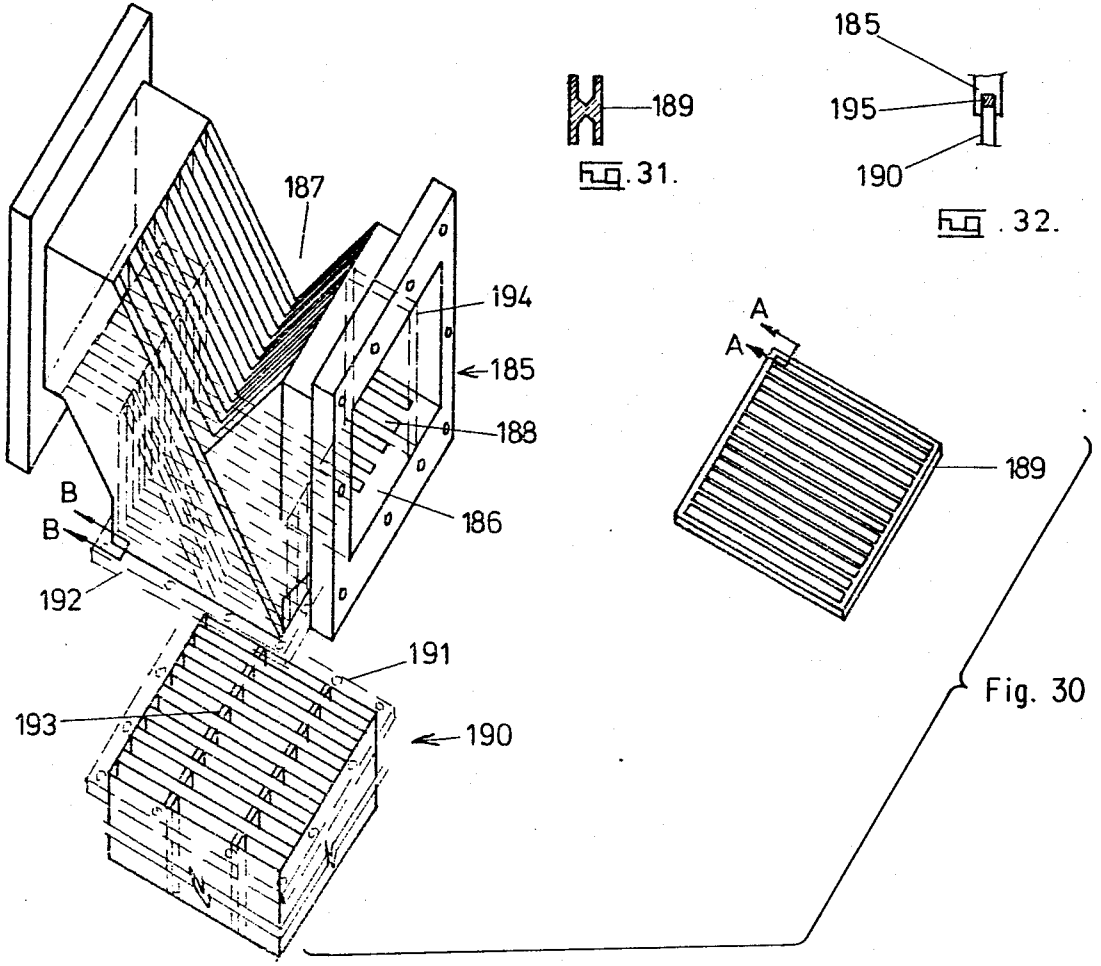
FIG. 30 is an exploded view of another type of heat exchanger constructed in accordance with the invention suitable for the food industry.
FIG. 31 is a section through A—A of FIG. 30.
FIG. 32 is a section through line B—B of FIG. 30.

Another type of heat exchanger is shown in FIG. 30 wherein manifold 185 has entry slot 186 having flow passages 188. Manifold 185 is provided with recess 187 which has no significant function but results in economy in production due to saving of material if required. Partition 194 is also shown. Gasket 189 is interposed between end plates 191 and 192 of core element 190 and manifold 185 as shown. Core element 190 is provided with reinforcing rods or flow dividers 193.

FIG. 31 shows the cross sectional profile of gasket 189 through A—A in FIG. 30 and FIG. 32 shows the interengagement of manifold 185 with core 190 with perimeter seal 195 interposed therebetween.

Figure 33:
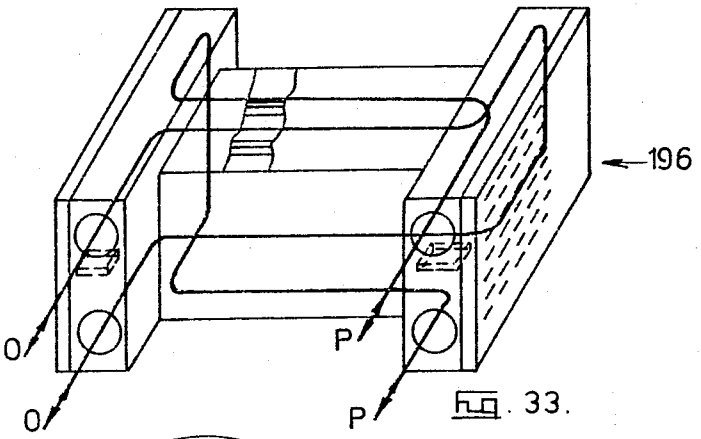
FIG. 33 is a perspective view of a heat exchanger unit constructed in accordance with the invention.

In FIG. 33 there is shown a heat exchanger 196 constructed in a similar fashion as previously described showing flow paths for operating fluid (O) and process fluid (P).

Figure 34:
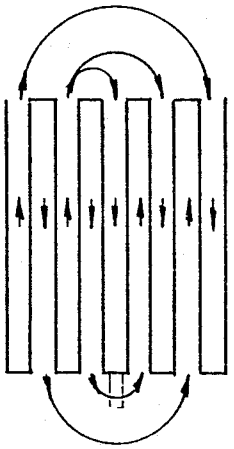
FIGS. 34–35 show alternative views of different flow directions of process fluid and/or working fluid in relation to heat exchanger units shown in FIG. 33.
Figure 35:
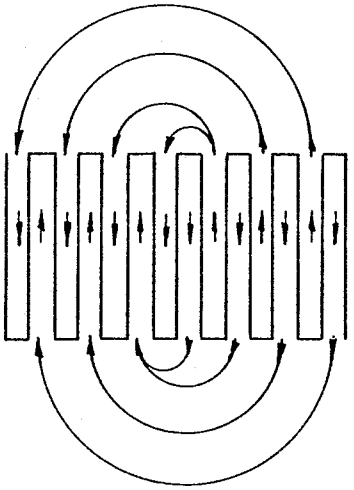

FIG. 34 shows a schematic view of one of the flow paths shown in FIG. 33 for a nine channel system, and FIG. 35 is a similar view to FIG. 34 but with particular reference to a 14 channel system.

Figure 37:
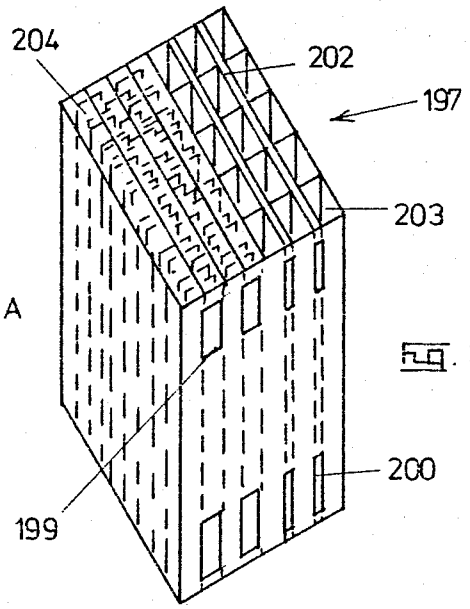
FIG. 37 is a perspective view of the core element shown in FIG. 36.
Figure 36:
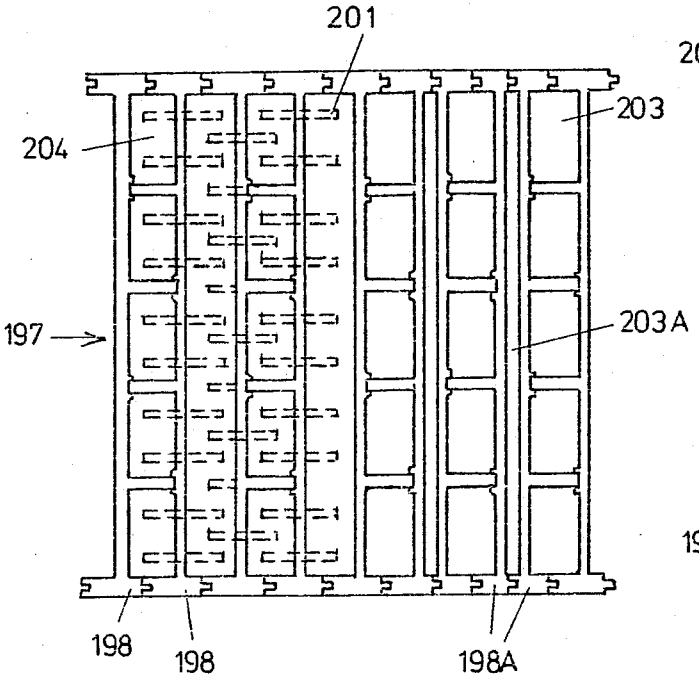
FIG. 36 shows another type of core element suitable for use in the present invention.
Figure 39:
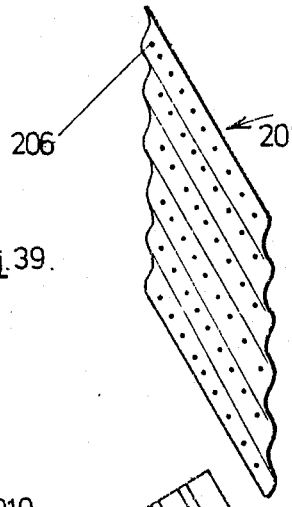
FIG. 39 is a perspective view of an individual plate for use in the core element of FIG. 38.

FIGS. 36 and 37 shows a core element 197 being made of interlocking components 198 or 198A which may be welded, cast, or releasably attached to each other in plug-socket fashion. There is also shown side entry ports 199 and 200 which are different shape and alternative types that may be used. There is also shown longitudinal plates 201 having the arrangement as shown in FIG. 36 in dotted outline or plates 202 shown in full outline which are again alternative types. Plates 201 or 202 form suitable flow dividers so as to form flow channels of different cross section such as for example flow channels 203, 203A and 204 as shown.

Figure 40:
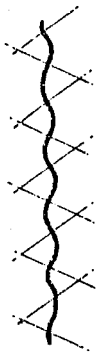
FIG. 40 is a side view of the plate of FIG. 39 showing flow directions of fluid passing through apertures in the plate.
Figure 38:
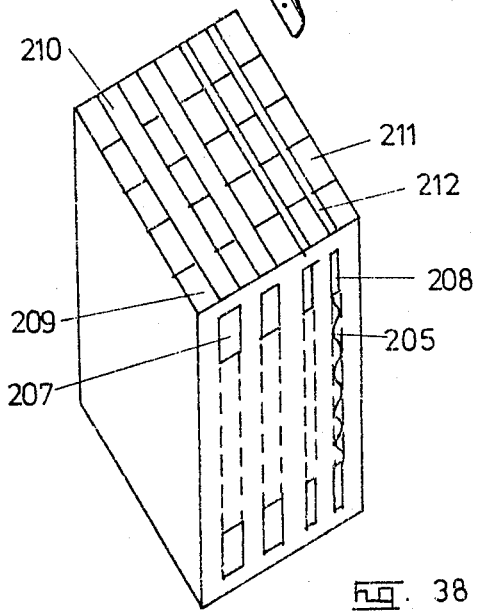
FIG. 38 is a perspective view of another type of core element for use in the invention.

In FIG. 38 an alternative type of core element is shown having corrugated plates 205 and apertures 206. Entry ports 207 and 208 are also shown. Flow channels 209 and 210 are also shown which again are alternative forms as are flow channels 211 and 212. The provision of corrugated plates provides a flow pattern as shown by the dotted lines in FIG. 40 and means that the effective interior surface area of the core element is very much increased causing longer retention time for fluids when travelling through the core element.

Figure 41:
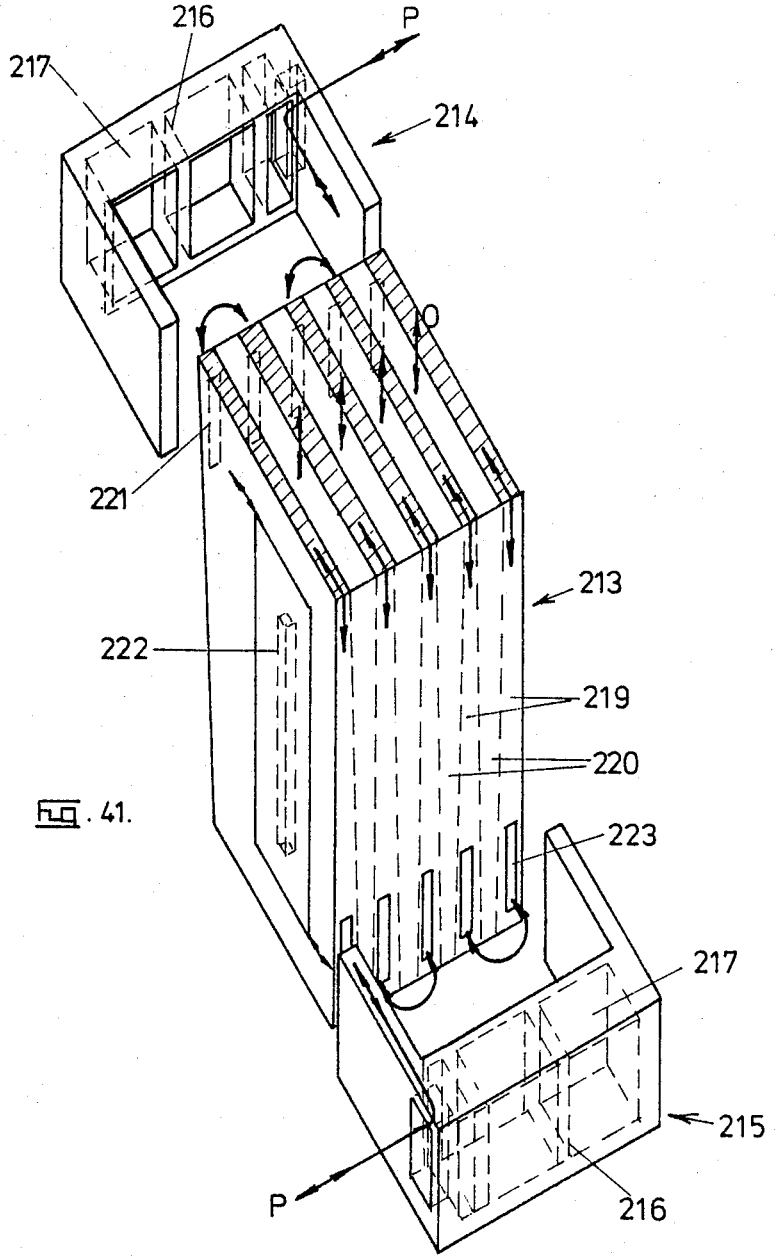
FIG. 41 is a perspective view of a heat exchanger constructed in accordance with the invention suitable for facilitating change of state of fluids passing therethrough.

In FIG. 41 there is shown heat exchanger having core element 213 and inlet/outlet component 214 and 215. Each component 214 and 215 includes partitions 216 in recesses 217. Core element 213 has longitudinal strengthening rods 222 and two sets of flow passages 219 and 220 of progressively increasing dimensions as shown. There is also shown flow slots 221 which register with component 214 and flow slots 223 which register with component 215 as shown. The different flow paths of operating or working fluid is designated by letter O and process fluid by letter P.

Flow passages 219 and 220 by having progressively increasing or decreasing dimensions from and to end facilitate change of state of fluids eg. gas to liquid, gas to solid or liquid to solid and vice versa.

As will be apparent from the foregoing discussion the invention in one aspect also provides heat exchangers having a greater ability to withstand pressures of the order of at least 2.5 p.s.i. more suitably about 5 p.s.i. and most preferably at least 10 p.s.i. These pressures refer to the pressure generated within the interior of the core when the process fluid and operating (or working) fluid are travelling therethrough.

The core elements as described above may be provided with longitudinally extending rods or plates which may also function as flow dividers providing a plurality of adjacent flow channels. These have been described with reference to the above drawings. There also may be provided peripheral support or stabilizer members also referred to in the foregoing drawings.

It will also be appreciated that the heat exchangers of the invention may be used with a plurality of different operating or process fluids. In this embodiment the inlet/ outlet module or return module where present may be provided with appropriate partitions for dividing the modules into a number of chambers which equal the number of different fluids being heated by the heat exchanger.

When modified in this manner and when using a core element such as that described in FIG. 2 above a heat exchanger in accordance with the invention may be placed in an automotive or engine intake or exhaust manifold or in a radiator tank for both industrial and automotive engines to cool both transmission and engine oils which may be mentioned as two different process fluids. In this case the operating fluid could be water.

In another form of the invention as described above there may be provided sealing means associated with each end of a core of fluid flow apparatus constructed in accordance with the invention wherein each core end may include a plurality of elongate slots wherein each slot may terminate a respective flow passage in the core which may comprise operating fluid passages and process fluid passages.

In this embodiment there may be provided sealing members which may include a plurality of fingers wherein each finger may be engageable in a respective elongate slot in such a manner as to permit passage of process and/or operating fluid from one flow passage to an adjoining flow passage in the core.

Preferably each sealing member includes a base portion from which said outwardly extending fingers may project. A suitable core for use in this aspect of the invention may be that described above in FIG. 2. At each end of the core may be provided a plurality of substantially U-shaped slots wherein each alternative slot is sealed at one longitudinal end and open at the other. In this arrangement the respective fingers of one or a pair of opposed sealing members as described above may be inserted into their mating array of slots through the respective open ends thereof. Each finger may be spaced from the base part of its mating U-shaped slot so as to provide clearance of operating fluid from one flow passage in the core to an adjacent flow passage.

In this arrangement there also may be provided a pair of opposed manifold components releasably secured to each other and retaining the abovementioned sealing members in position. Suitably there is also provided a cover plate releasably attached to the pair of manifold components and optionally a sealing gasket interposed between one end of the core and the cover plate.

In relation to the heat exchangers shown in FIGS. 1 and 2, it will be appreciated that for N passes of process fluid through the core, there will be (N+1) passes of operating fluid or vice versa.

Examples of process fluids which may be utilized in the heat exchanger of the invention are liquids such as engine oil, transmission oil and gases such as air. A suitable operating fluid is water.

The heat exchanger of the invention will be found useful in marine applications, industrial applications and treatment of waste or process fluids such as the recovery of fats therefrom.

While the abovementioned description of the fluid flow apparatus of the invention is primarily concerned with a heat exchange function it will be appreciated that the apparatus may be used for transfer of other fluid properties between different fluids.

Also by making it possible for maximum transfer of heat energy by making maximum benefit of the available working area of the apparatus, this enables one to obtain more effective control of other fluid parameters such as flow velocity, flow distribution and temperature gradient.

We claim:

1. A heat exchanger comprising: a core element, said core element including a plurality of substantially parallel plates in stacked relationship so as to define a multiplicity of flow passages for a working fluid alternating with a plurality of flow passages for a process fluid, said working fluid flow passages being substantially parallel to said process fluid flow passages, wherein one of said working or process fluids makes at least two passes through said core element in different flow passages in series and the other of said working or process fluids makes a single pass through said core element with both working and process fluids exiting from each passage externally of said core element; diversion means associated with one end of said core element for diverting said one fluid back through said core element so as to make said at least two passes therethrough and for directing flow of said other fluid, and access means associated with another end of said core element for directing flow of both said working fluid and said process fluid; said plurality of plates forming a plurality of openings at said one end and said another end of said core element, whereby the specific juxtaposition of parallel plates, the diversion means, and the access means selectively controls the flow of the process fluid and the working fluid through the heat exchanger.

2. A heat exchanger according to claim 1, wherein said access means includes a plurality of slots wherein each slot is aligned with a corresponding flow passage for said other fluid.

3. A heat exchanger according to claim 2, wherein the access means includes an access port of said one fluid.

4. A heat exchanger according to claim 1, wherein both said access means and said diversion means includes a plurality of slots wherein each slot of said access means and said diversion means is aligned with a corresponding flow passage for said other fluid.

5. A heat exchanger according to claim 1, wherein both said access means and said diversion means includes access ports for said one fluid and said other fluid.

6. A heat exchanger according to claim 1, wherein said core element includes a plurality of access slots located in a side surface thereof adjacent said one end and said another end respectively.

7. A heat exchanger comprising: a core element, said core element including a plurality of substantially parallel plates in stacked relationship so as to define a multiplicity of flow passages for a working fluid alternating with a plurality of flow passages for a process fluid, said working fluid flow passages being substantially parallel to said process fluid flow passages, wherein one of said working or process fluids makes at least two passes through said core element in different flow passages in series and the other of said working or process fluids makes a single pass through said core element with both working and process fluids exiting from each passage externally of said core element; said core element including a plurality of access slots located in a side surface thereof adjacent each end thereof; diversion means associated with each said end of the core element for diverting said one fluid back through the core element, said plurality of plates forming a plurality of openings at each said end thereof; whereby the specific juxtaposition of the parallel plates and the diversion means selectively controls the flow of process fluid or working fluid through the heat exchanger.

8. A heat exchanger comprising: a core element, said core element including a plurality of substantially parallel plates in stacked relationship so as to define a multiplicity of flow passages for a working fluid alternating with a plurality of flow passages for a process fluid, said working fluid flow passages being substantially parallel to said process fluid flow passages, wherein one of said working or process fluids makes at least two passes through said core element in different flow passages in series and the other of said working or process fluids makes a single pass through said core element with both working and process fluids exciting from each passage externally of the core element; diversion means associated with one end of said core element for diverting said one fluid back through said core element so as to make said at least two passes therethrough; and access means associated with another end of said core element for directing flow of said one fluid; said plurality of plates forming a plurality of openings at said one end and said another end of the core element; whereby the core element, the access means, and the diversion means may be in the form of components and may be so arranged and interconnected that the specific juxtaposition thereof in combination with the substantially parallel plates selectively controls the flow of the process fluid or the working fluid through the heat exchanger to suit a desired application.

* * * * *